United States Patent [19]

Yacoe

[11] Patent Number: 4,679,361

[45] Date of Patent: Jul. 14, 1987

[54] POLYHEDRAL STRUCTURES THAT APPROXIMATE A SPHERE

[76] Inventor: J. Craig Yacoe, 108 Harvey La., Chadds Ford, Pa. 19317

[21] Appl. No.: 817,927

[22] Filed: Jan. 13, 1986

[51] Int. Cl.[4] ..... E04B 1/32; E04B 7/08

[52] U.S. Cl. ..... 52/81; 52/DIG. 10; D25/13

[58] Field of Search ..... 51/81, DIG. 10, 80; D25/13, 19

[56] References Cited

U.S. PATENT DOCUMENTS

| | | | |
|---|---|---|---|
| 2,682,235 | 6/1954 | Fuller | 52/81 |
| 3,114,176 | 12/1963 | Miller | 52/81 |
| 3,341,989 | 9/1967 | Emmerich | 52/81 |
| 3,646,718 | 3/1972 | McKenna | 52/81 |
| 3,696,566 | 10/1972 | Langner | 52/DIG. 10 |
| 3,881,284 | 5/1975 | Martin | 52/81 |
| 3,898,777 | 8/1975 | Georgiev et al. | 52/81 |
| 4,026,078 | 5/1977 | Ahern et al. | 52/81 |
| 4,075,813 | 2/1978 | Nalick | 52/81 |
| 4,160,345 | 7/1979 | Nalick | 52/81 |
| 4,258,513 | 3/1981 | Bergman | 52/81 |
| 4,288,947 | 9/1981 | Huang | 52/81 |

FOREIGN PATENT DOCUMENTS

| | | | |
|---|---|---|---|
| 669760 | 8/1963 | Canada | 52/81 |
| 670583 | 9/1963 | Canada | 52/81 |
| 1060867 | 3/1967 | United Kingdom | 58/81 |

OTHER PUBLICATIONS

Dome Book 2; Pacific Domes; p. 102; 1971.

*Primary Examiner*—Henry E. Raduazo
*Assistant Examiner*—Michael Safavi
*Attorney, Agent, or Firm*—Donald W. Huntley

[57] ABSTRACT

A polyhedron that approximates a sphere made up of generally irregular polygons.

8 Claims, 4 Drawing Figures

POLYHEDRAL STRUCTURES THAT APPROXIMATE A SPHERE

BACKGROUND OF THE INVENTION

Engineering for building construction has, in the past, produced a wide variety of structural designs. One of the more noteworthy of these designs is that described in Fuller, U.S. Pat. No. 2,682,235, which relates to a geodesic dome. The domes described in the Fuller Patent are said to provide protective shelter at a significantly lower weight per square foot of floor than had previously been possible using conventional wall and roof designs. The solution provided by Fuller is a dome-like structure prepared from substantially equilateral triangles.

Geodesic domes have, in the past, been used for a wide variety of structures. Spheres of approximately equilateral triangles in the geodesic pattern do, in fact, exhibit considerable strength. However, a number of practical problems are inherent in building structures based on a three-way grid defining substantially equilateral triangles. With either a spherical or hemispherical dome structure based on this pattern, each vertex intersection of surface planes represents the meeting of five or six triangular planes at a point. Such intersections require careful fitting and sealing. When a structure is patterned on a bisected sphere to form a dome, additional difficulties are encountered using equilateral triangles as the planar surfaces. These difficulties arise from the fact that alternate intersections of five or six triangles, in the geodesic pattern, define a surface which is either concave or convex with respect to the enclosed sphere. As a result, the perimeter of a geodesic dome, at the point of meeting a horizontal surface or other plane, defines a zigzag pattern. Moreover, the faces at the edge of the dome do not meet the planar surface at a right angle. These considerations make it difficult to incorporate basic architectural elements such as doors and windows into a geodesic dome.

SUMMARY OF THE INVENTION

The instant invention provides a spherically shaped polyhedral structure composed of fewer components than a geodesic structure and in which the perimeter of a dome prepared from such structure can have faces which are substantially perpendicular to a plane intersecting the dome.

Specifically, the instant invention provides a polyhedron that approximates a sphere, the polyhedron having a plurality of polygonal faces, in which each vertex of the polyhedron is a junction of three or four polygonal edges, wherein each edge of each polygon is tangent to the approximated sphere at one point, wherein the polyhedron comprises two faces that are regular polygons, and at least half of the remaining faces are selected from non-equilateral hexagons and pentagons.

DETAILED DESCRIPTION OF THE INVENTION

Figure 1:
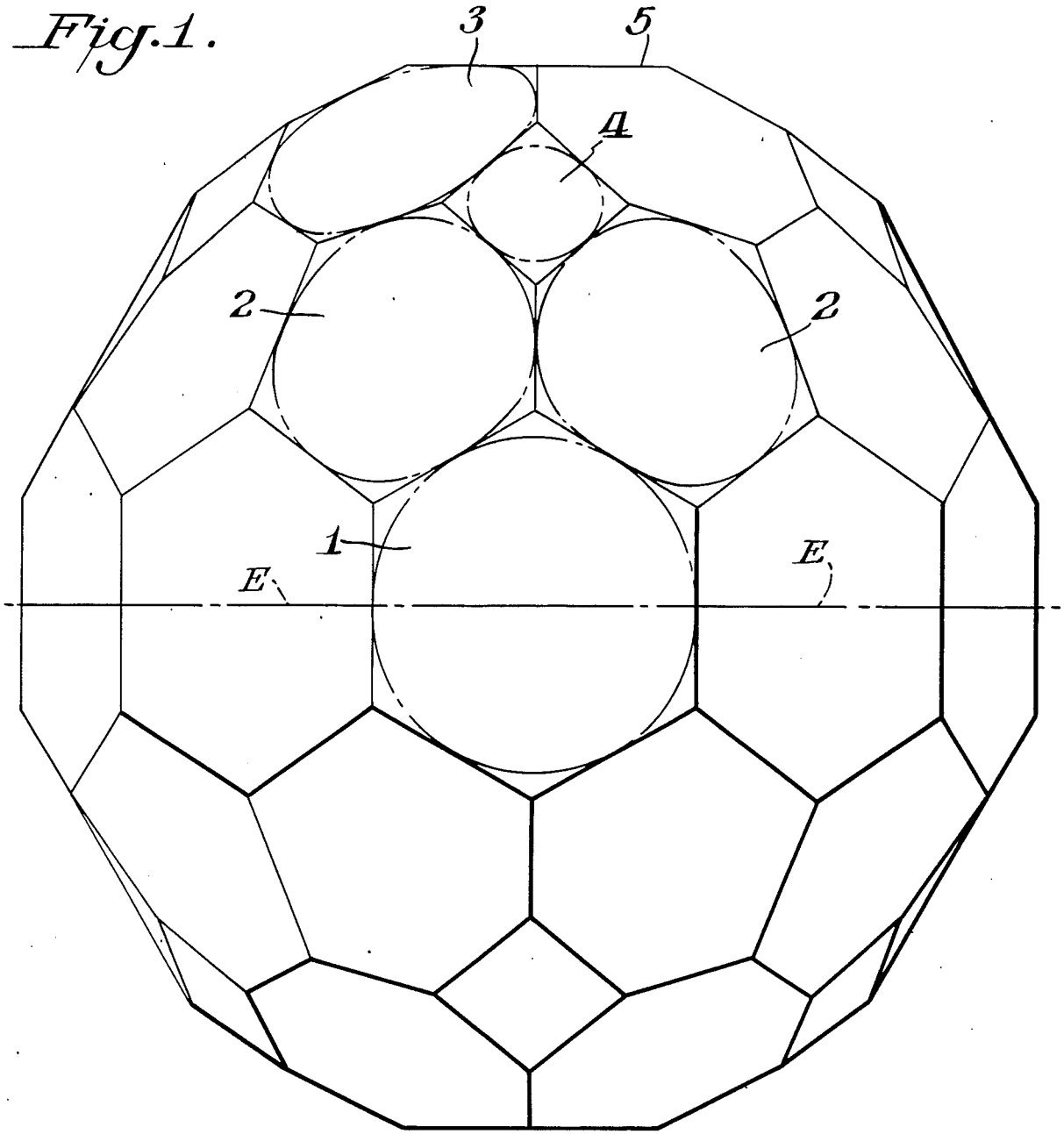
FIG. 1 is a side equatorial view of a polyhedron of the present invention.

The polyhedral structures of the present invention have two faces that are regular polygons, and at least half of the other faces are non-equilateral pentagons or hexagons. The structures are designed as to provide faces of approximately equal size and to minimize the number of faces in the spherical structure as well as the number of polygons intersecting at each vertex of the surface.

The present polyhedral structures are characterized by at least fourteen faces, and each vertex, that is, where more than two polygonal edges come together, is a junction of three or four polygonal edges. In addition, the sphere which is approximated by the present polyhedron touches each side of each polygon at only one point. Phrased differently, the sphere that is approximated by a polyhedron of the present invention intersects each polygon at an inscribed circle within each polygonal face, and each such inscribed circle is tangent to the inscribed circle in each adjacent polygon.

In one form of the present invention, the polyhedrons are characterized by an equatorial ring of hexagons and two parallel polar polygons perpendicular to a plane that vertically bisects the sphere. The remaining polygonal components of the polyhedron are determined by the number of hexagons in the equatorial ring.

The ring of hexagons in the present polyhedrons at or closest to the equator of the approximated sphere is six or more in number and is a power of 2 times an odd integer of 1 to 9. Thus, for example, the equatorial ring can comprise 6, 8, 10, 12, 14, 16, 18, 20, 24, 28, 32, 36, 40, 48, 56, 64, 72, 80, 96, 112, 128, 144, 160, 192, 224, 256, 288, 320, 384, 448, 512, 576, 640, 768, 896, or 1,024 hexagons.

Starting with the equatorial ring, successive rings toward the poles of the sphere are constructed, generally from polygons having 4 to 8 sides. Each polygon in each ring is perpendicular to a radius of the sphere which is approximated by the polyhedron, and the inscribed circle in each polygon is tangent to the inscribed circle of each adjacent polygon, as previously noted. The size of the polygons is adjusted so that the polygons in successive rings moving toward the poles of the sphere are as nearly equal as possible to the size of the polygons in the preceding ring. In determining the size of the polygons, three alternatives should be considered, these being that the next most polar ring contain the same number of polygons as the preceding ring; or that the next most polar ring contain one-half the number of polygons in the preceding ring; or that the next unit is a single polar polygon.

The size and configuration of non-equatorial rings of polygons can best be determined by the inscribed circles, since the inscribed circles must be tangent to the inscribed circles of each adjacent polygon. The term inscribed circle is used in its usual sense to mean a circle tangent to each side of a polygon. The planes defined by the circles intersect at the edges of polygons to form a polyhedron.

In the polyhedral structures of the present invention, each of the polygons in the structure, with the exception of the polar polygons, is non-equilateral. Thus, the inscribed circle of each polygon, through its tangency with adjacent inscribed circles, uniquely determines the angle of intersection between polygons as well as the number of faces in the polygons of each ring.

In the event that the closest approximation of the next most polar ring to the size of the preceding ring is achieved by reducing the members in the ring by one-half, there are vertices where four edges meet and it is often desirable to insert filler polygons so that only three edges meet at each vertex.

Figure 2:
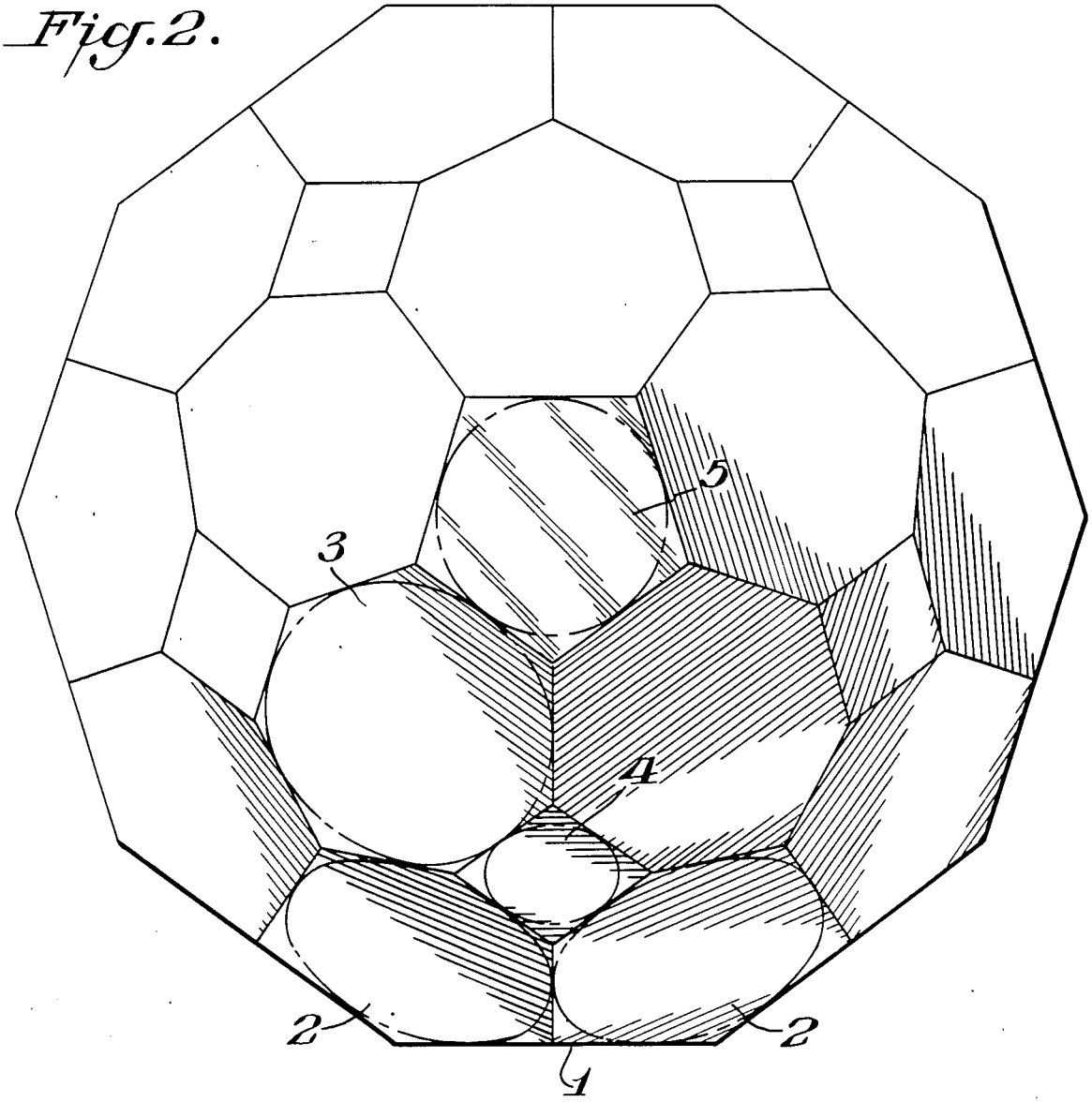
FIG. 2 is a polar view of a polyhedron of the present invention.

A construction of one embodiment of the present invention is more fully illustrated in FIG. 1, in which ten equatorial hexagons (1) are present, the inscribed circles of which, shown by dotted lines, are tangent to each other and the centers of which lie on the equator E of the approximated sphere. The next most polar ring is also composed of ten hexagons (2), the inscribed circles of which are tangent to each other and those of the equatorial ring. The closest approximation to the preceding ring for the polar-most ring is achieved by reducing the number of polygons by one-half, resulting in seven-sided polygons (3). With the reduction in the number of ring components, filler polygons (4) are inserted at alternate junctions of the heptagons and the preceding ring of hexagons. Polar caps (5), one of which is shown in FIG. 2, are regular pentagons.

Figure 4:
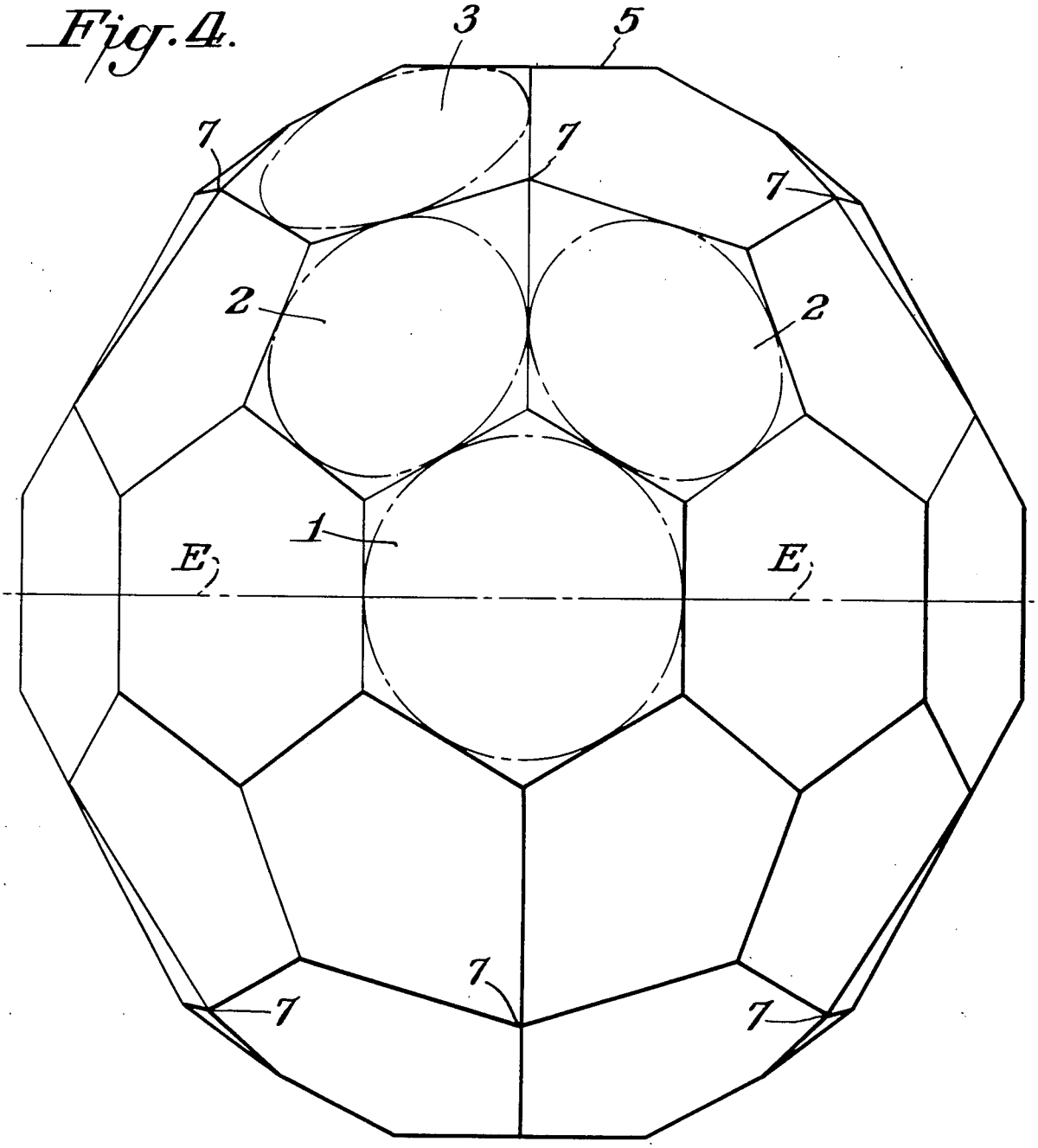
FIG. 4 is a side equatorial view of another polyhedron of the present invention.

In the event that filler polygons are not inserted, as described in the previous paragraph, alternate polygonal faces in the preceding ring and the next most polar ring will meet with vertexes of four edges. This configuration is shown in FIG. 4, in which the ring composed of polygons 3 has one-half the number of faces as the ring composed of polygons 2, and alternate faces meet at points 7, where four edges meet.

Figure 3:
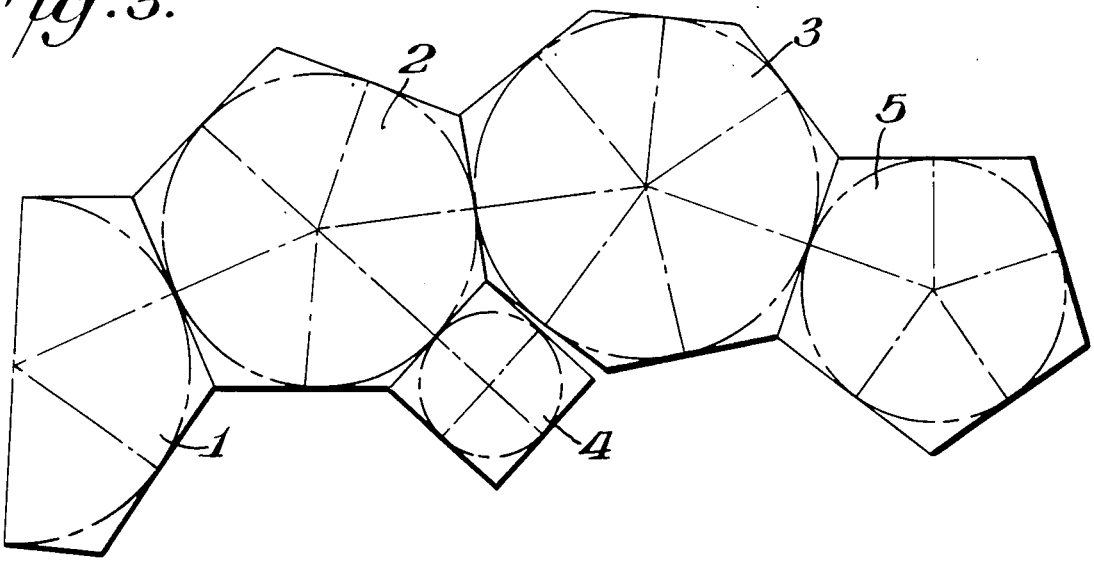
FIG. 3 is a plane view of representative polygonal faces used to make up the polyhedron of FIGS. 1 and 2.

The elements of this polyhedron, in a planar arrangement, are illustrated in FIG. 3. In that Figure, one-half of equatorial hexagon (1) is shown, and the inscribed circle is tangent to that of the hexagon (2) of the next most polar ring. This, in turn, is tangent to the inscribed circle of heptagon (3) which, in turn, is tangent to the inscribed circle of polar pentagon (5). The filler quadragon (4) is shown adjacent and tangent to hexagon (2).

In the present polyhedral structures, the polygons of each ring are congruent or mirror images of each other.

The completed polyhedron most closely approximates a sphere which would intersect the polyhedron at the inscribed circle of each polygon from which it is prepared. In this manner, each side of each polygon intersects the sphere at only one point.

As previously noted, the size of the polygons and their inscribed circles in successively more polar rings should be as close as possible in size to the inscribed circles in the equatorial ring.

When the number of polygons in a more polar ring is reduced by one-half from the preceding ring, filler quadragons can be inserted to make the polygons more uniform in size and for a more nearly spherical surface of the polyhedron. The filler polygons are placed at the intersections of four planes, the filler quadragons being defined by their inscribed circles being tangent to the inscribed circles of the four neighboring polygons. With these filler polygons, the entire polyhedron has only three edges meeting each vertex.

The equatorial belt of the present polyhedrons is preferably substantially perpendicular to the plane defined by the equator of the sphere approximated by the polyhedron. As will be evident to those skilled in the art, the full polyhedron can be bisected to provide a dome structure. This bisection is typically along the equatorial band of hexagons. Depending on the point at which the bisection is carried out, the resulting equatorial polygons will be pentagonal or triangular. In a full polyhedral structure of this embodiment of the present invention, the vertical sides of the hexagons are both parallel to each other and perpendicular to the plane defined by the equator. Deviation from this perpendicularity can be introduced by slanting the first ring of hexagons. Similarly, when the polyhedron has a ring of hexagons perpendicular to the equator of the sphere, the parallel sides of the equatorial hexagons can be lengthened, if desired, so that an inscribed circle will only be tangent to four of the six sides at one time. These and other equivalent variations of the present polyhedrons will be evident to the skilled artisan.

The precise dimensions of the polygons in the present polyhedrons can be determined empirically, or, if desired, through the use of analytical spherical geometry. In the event that analytical geometry is used, the sphere approximated by the polyhedron is defined with a geographic description and a Cartesian coordinate system. In this manner, the sphere is assumed to be of unit radius, the z-axis is vertical with north as the positive direction, the positive x-axis passes through the intersection of the prime meridian with the equator, that is, the point of 0 latitude and 0 longitude, and the positive y-axis passes through the point of 0 latitude and longitude 90 degrees. With latitude symbolized by (th) and longitude by (ph), the following expressions define the rectangular coordinates of a point P on the surface of the sphere at that latitude and longitude:

$$x=\cos(th)\cos(ph)$$

$$y=\cos(th)\sin(ph)$$

$$z=\sin(th)$$

These are also the direction cosines of a line from the center of the sphere (assumed to be at the origin of the system of coordinates) through point P. Accordingly, if a plane perpendicular to that line intersects it at a point whose distance from the origin is d, then the equation of the plane is $$x\cos(th)\cos(ph)+y\cos(th)\sin(ph)+z\sin(th)=d \qquad (1)$$

The circle in which this plane intersects the sphere is then represented by (1) together with the equation of the sphere, which is $$x^2+y^2+z^2=1 \qquad (2)$$

The location of an inscribed circle of a polygon is described by the latitude and longitude of the point in which a line from the origin through the center of the circle meets the surface of the sphere. This is referenced as the latitude and longitude of the circle, or of the center of the circle. The number of polygons, with their inscribed circles, in the equatorial ring is selected as described above, and is here designated "n". These circles can be arranged in either of two ways. In Case I, the circles are arranged with their centers at latitude zero and with each circle tangent to its two neighbors. Each circle would then have a width covering 360/n degrees of longitude, and its radius would be sin (180/n).

More generally, however, if a ring of n equal circles is arranged with the centers of the circles at latitude (th), and with each circle tangent to its neighbors, then the radius of each circle is $r=\cos(th)\sin(180/n)$. In Case Ib in which all of the circles in the first ring are tangent to the equator, the value of (th) is given by the equation $\cos^2(th)=1/(1+\sin^2(180/n))$ Case II is a second possibility that is more complicated, both to describe and in the computation of the value of the latitude. In Case II, a ring of n equal circles is at latitude (th) and at longitudes which are even multiples of (180/n), with the latitude and radius such that each circle in the ring is tangent not only to its two neighbors in that ring, but also to two neighboring circles in the ring below, in which the circles are at latitude (−th) and longitudes which are odd multiples of (180/n). Mathematjcal statement of the fact of tangency between circles in different rings is the basis for determination of the value of (th). Since this arrangement is symmetrical with respect to the equator, the points of tangency between circles in different rings all lie on the equator. This fact could also be a basis for determination of the value of (th), but the method based simply on the fact of tangency is simpler, and is as follows.

The circle at latitude (th) and longitude zero is the intersection of the sphere (2) with the plane the equation of which is $$x\cos(th)+z\sin(th)=d \tag{3}$$

where $d=\sqrt{1-r^2}$ is the distance from the origin to the center of the circle, and r is given, as previously noted, by $r=\cos(th)\sin(180/n)$. The circle at latitude (−th) and longitude (180/n) is the intersection of the sphere (2) with the plane, the equation of which is $$x\cos(th)\cos(180/n)+y\cos(th)\sin(180/n)-z\sin(th)=d \tag{4}$$

Any point common to both circles must satisfy equations (2), (3), and (4), and by substituting from (3) and (4) into (2) a quadratic equation in x is obtained which, if the circles are tangent, must have only 1 solution. Its discriminant therefore equals zero, which gives an equation with two unknowns, d and (th). However, as noted above, d is related to r, which is a function of (th); thus d can be eliminated and an equation obtained in which (th) is the only unknown. This equation is $$(A+1)t^3-(A-0.5)t^2-2(B+1)t+2B=0$$

where $t=\cos^2(th)$, $A=\cos(180/n)$, and $B=csc^2(180/n)$. This equation can be solved by Newton's method, using an initial estimate of 1 for the value of t.

In setting up a dome, the equatorial ring would not necessarily be present. It serves to establish a condition whereby the locations of the circles in the upper rings are determined.

As an example of the case Ib in which all of the circles in the equatorial ring are tangent to the equator, with n=4, (th) is 35.26 degrees and r is 0.57735; with n=10, (th) is 17.17 degrees and r is 0.29524.

For the Case II, in which a ring of n equal circles is at latitude (th), with n=4, (th) is 27.88 degrees and r is 0.62503; with n=10, (th) is 9.45 degrees and r is 0.30482.

Having set up a base ring, by whatever method, further rings are added at higher (i.e., more northern) latitudes, in such a way that each circle in a new ring will be tangent not only to its two neighbors in the same ring, but also to two circles in the ring below it. The added ring is initially assumed to contain the same number of circles as the ring below it. This means that if a circle in the new ring is centered at longitude zero, there will be a circle (to which it is tangent) in the ring below centered at longitude $(ph)=(180/n)$, and the new circle will be tangent also to the meridian of longitude (ph). Assuming that the latitude of the circles in the ring below is (th1) and their distance from the center of the sphere is d1, while the circles in the new rings are located at latitude (th) and are at a distance d from the center of the sphere, all these conditions can be expressed mathematically in the following way.

The circle in the ring below as described above is specified by equation (2) (the sphere) together with the equation of the plane $$x\cos(th1)\cos(ph)+y\cos(th1)\sin(ph)+z\sin(th1)=d1 \tag{6}$$

The circle in the new ring at longitude zero is specified by the equaton of the sphere together with that of the plane $$x\cos(th)+z\sin(th)=d \tag{7}$$

Finally, the meridian of longtude (ph) is specified by the equation of the sphere together with that of the plane $$y=x\tan(ph) \tag{8}$$

The requirement that the new circle be tangent to the meridian of longtude (ph) means that equations (2), (7), and (8) have only one solution. If z is substituted in terms of x from (7) and for y in terms of x from (8), equation (2) becomes a quadratic in x, and if it is to have only one root, its discriminant is zero. This leads to the relation already noted, whereby $$d^2=1-r^2, \text{ with } r-\cos(th)\sin(ph).$$

The requirement that the new circle be tangent to the circle in the ring below means that there must be only one solution to equations (2), (6), and (7) taken together. Here z must be substituted in terms of x from (7) into (6), so that the latter can be solved for y in terms of x. Substituting the expressions for y and z in terms of x into (2) again gives a quadratic in x which must have only one solution, so again the discriminant must be zero. In this case, however, even if d is substituted in terms of (th) to provide an equation in which (th) is the only unknown, it cannot be solved in closed form.

The expression for the descriminenant is:

$$csc^2(th)(2ABd\cos(th)+1-d^2-B^2+A^2(\sin^2(th)-d^2)) \tag{9}$$

Where $A=\cot(ph)-\tan(th1)\cot th\ csc(ph)$ and $B=\tan(th1)\ csc(ph)\ d1csc(th1)-dcsc(th))$.

Therefore, an iterative method must be used to solve for (th), noting that its value must lie between (th1) and 90 degrees; these values can therefore be taken as, respectively, a lower limit (ths) and an upper limit (thb) for (th), and proceeding as follows:

Set $(ths)=(th1)$, $(thb)=90$, $(thp)=0$, $(th)=((ths)+(thb))/2$ and iterate as follows until the absolute value of (th)−(thp) is less than 0.000001:

Set $(thp)=(th)$; calculate r and d from (th) and (ph), then A and B, and from (9), omitting the factor $csc^2$(th), which is always positive) the value of the discriminant (DIS).

If DIS is greater than zero, replace (thb) by (th); if DIS is less than zero, replace (ths) by (th); in either case let the value of (th) be replaced by ((ths)+(thb))/2.

When this process has converged, (th) is the desired latitude and r is the radius of the circle.

The same method can be used to deal with the case in which the number of circles in the new ring is half the number in the ring below it. It is only necessary to double the value of (ph) in relation from which r and d are calculated (but not in the expressions for A and B).

Another process involved in covering the sphere with circles is the addition of a single circle centered at latitude 90 degrees and tangent to each of the circles in the last ring added (this single circle is usually referred to as the "polar" circle). If the circles in the last ring added are at latitude (th1), have radius r1, and are distant d1 from the center of the sphere, then the radius of the polar circle is given by $$r=d1\cos(th1)-r1\sin(th1) \tag{10}$$

The locations of the points of contact between the various adjacent circles in this structure are determined next. For this purpose, the coordinates of the points of contact, as well as the coordinates of the point of greatest latitude (the "twelve o'clock" point) or the point of least latitude (the "six o'clock" point) on each circle, are needed to serve as reference points in the determination of the angular positions of the contact points.

For determination of the coordinates of the twelve o'clock or the six o'clock point, a circle is assumed to be located at latitude (th) and longitude (ph), with radius r and distance d from the center of the sphere. Then the coordinates of the twelve o'clock position on this circle are $$x=(d\cos(th)-r\sin(th))\cos(ph)$$

$$y=(d\cos(th)-r\sin(th))\sin(ph)$$

$$z=d\sin(th)+r\cos(th)$$

Expressions for the coordinates of the six o'clock point are obtained by changing the two minus signs to plus and the plus sign to minus in the above expressions for the coordinates of the twelve o'clock point.

In determining coordinates of contact points, the case is first considered in which the circles are in the same ring. If both circles are at latitude (th), with one of them at longitude 0, the other at longitude (360/n), and if the distance from the center of the sphere to the center of either circle is d, then the coordinates of the point of contact of the circles are $$z=\sin(th)/d$$

$$x=d\sec(th)-z\tan(th)$$

$$y=x\tan(360/n)$$

For the case in which the circles are in different rings, one of the circles is assumed to be at latitude (th1) and longitude (ph1), the other circle at latitude (th2) and longitude (ph2). The following relationships then apply:

$$Ai=\cos(thi)\cos(phi)/di$$

$$Bi=\cos(thi)\sin(phi)/di$$

$$Ci=\sin(thi)/di$$

for i=1,2. Then the coordinates of the point of tangency of the circles, given that d1 and d2 are distances of the centers of the circles from the center of the sphere compatible with the fact of tangency, are as follows:

$$x=((B2-B1)(A1B2-A2B1)+C1-C2)(C1A2-C2A1))/S$$

$$y=(C2-C1+(A2C1-A1C2)x)/(B1C2-B2C1)$$

$$z=(B1-B2+(A1B2-A2B1)x)/(B1C2-B2C1)$$

where $$S=(A1B2-A2B1)^2+(C1A2-C2A1)^2+(B1C2-B2C1)^2$$

In the present application, it is assumed that (ph1) is zero, and these expressions then simplify to $$x=((B2)^2A1+(C1-C2)(A2C1-A1C2))/T$$

$$y=(C1-C2+(A1C2-A2C1)x)/(B2C1)$$

$$z=(1-A1x)/C1$$

where $$T=(B2)^2((A1)^2+(C1)^2+(A2C1-A1C2)^2$$

B1 is now zero, and simpler expressions apply for A1 and C1. If (th1) is also zero, the following expressions for the coordinates apply:

$$x=d1$$

$$y=B2(A1-A2)/(A1((B2)^2+(C2)^2))$$

$$z=C2y/B2$$

Given the coordinates of two points on a circle of radius r, the angular separation of the two points is given by $$2\arctan(u/\sqrt{r^2-u^2})$$

where u is one-half the length of the chord joining the two points.

In the event that neighboring rings are present in which the upper one has half as many circles as the lower one, then a circle in the lower ring at longitude (ph) is tangent to one in the upper ring at longitude 2(ph), with neighboring circles at longitudes −(ph) and −2(ph) respectively also tangent to one another. These four circles surround an area (external to all the circles) which may be undesirably large, and since this area is symmetrical with respect to longitude zero, it is possible to cover it partially with a circle which is tangent to all four of the bounding circles. Also because of the symmetry, it is necessary only to ensure that the new circle is tangent to the circles at longitudes (ph) and 2(ph).

If the circle at longitude (ph) is set to be at latitude (th1), the circle at longitude 2(ph) is at latitude (th2), and the distances from the center of the sphere to the centers of the circles are respectively d1 and d2. These are all known quantities; the unknowns are (th), the latitude of the new circle (which is at longitude zero), and d, the distance from the center of the sphere to the center of the new circle. The procedure is as before, setting up the equations of the planes of the two circles which are required to be tangent, and using them to eliminate two of the variables from the equation of the sphere. Because of tangency, the resulting quadratic equation must have only one root, which allows setting up an equation in d and (th) by setting the discriminant of this quadratic to zero. A1, B1 and C1 are defined as follows:

$$A1 = d1\sec(th1)csc(ph)$$

$$B1 = \tan(th1)csc(ph)$$

$$C1 = \cot(ph)$$

The equation which results from the tangency of the new circle with the circle in the lower ring is then:

$$k1d^2 - k2d + k3 = 0 \quad (11)$$

where $$k1 = csc^2(th)(1 + (B1)^2 + (C1)^2$$

$$k2 = 2A1csc(th)(B1 + C1\cot(th))$$

$$k3 = csc^2(th)((A1)^2 - 1) - (C1 - B1\cot(th))^2$$

If a value for (th) is assumed, this equation can be solved for d, two values of which will satisfy the tangency requirement. Of these two values, the larger one corresponds to the (new) circle of smaller radius, which is the one desired. The other circle would be tangent to the circle in the lower ring at its farther side. A single value of d is thus obtained.

By changing all the 1's to 2's on the right hand sides of the equations for A1, B1, and C1, and replacing (ph) by 2(ph), expressions for A2, B2, and C2 are obtained which are substituted for A1, B1 and C1 in equation (11) to obtain another quadratic in d, which is designated equation (12). This is solved for d using the same assumed value of (th) as was used in solving (11), again taking the larger root. If the two values of d agree, the assumed value of (th) is the correct value of latitude for the new circle, and from the value of d we can obtain the radius of the new circle from $$r = \sqrt{1 - d^2}$$

If the two values of d do not agree, then (th) must be adjusted and the equations for d solved again. The adjustment is conveniently done by the method of bisection, which is initialized by taking (th1) (used in calculating A1, B1, C1 for use in eq (11)) as a lower limit and (th2) (used in calc A2, B2, C2 for use in eq (12)) as an upper limit for (th). One of the limits is adjusted, then (th) taken as the mean of the (new) limits. This is the method used to find the value of (th) which would make the discriminant expressed by (10) equal to zero. In the present case, the limit to be adjusted is selected according to the relative magnitude of the two values of d. If the value of d obtained by solving (11) is larger than the value obtained by solving (12), it means that the new circle which is tangent to the circle in the lower ring is smaller than the new circle which is tangent to the circle in the upper ring. In this case a larger value of (th) is used, and therefore the lower limit is replaced by the current value of (th). If the two values of d are in the opposite order of magnitude, replace the upper limit by the current value of (th). In either case, the limits are averaged to obtain a new value of (th) and the calculation of the two values of d is repeated, continuing until the two values agree.

The new circle obtained in this way is referred to hereafter as an "auxiliary" circle, since it is in fact an adjunct to the two neighboring rings, and is not itself a member of a ring of contiguous circles.

This completes the mathematical description of the process of creating a set of circles covering the sphere, each of which is tangent to all its immediate neighbors. A polyhedron is next generated from this set of circles.

For the case in which there are no auxiliary circles, and all rings contain the same number of circles, a set of immediate neighbors always consists of three circles, two in one ring and the other either in a neighboring ring or else the polar circle. Each of the three circles is perpendicular to a different radius of the sphere; therefore, none of the planes of the three circles are parallel, so the three planes, if extended beyond the circles, meet in a single point. This point is a vertex of the desired polyhedron, and the lines of intersection of the planes of neighboring circles, taken two at a time, are edges of the polyhedron. The point of tangency of two of the circles, since it belongs to both circles and therefore to their planes, is on the line of intersection of these planes. That is, it is on an edge of the polyhedron; and because this point is on the circles, it is also on the surface of the sphere. Finally, it is the only point of that edge which is on the sphere, because the rest of the line of intersection is outside of both circles and therefore outside of the sphere.

Take next the case of two neighboring rings, the upper one of which has half as many circles as the lower one. The space where an auxiliary circle would go, if present, is surrounded by four circles, and the question arises whether extension of the planes of these four circles until they meet, would result in single point.

If it is assumed that two circles in the lower ring are at latitude (th1) and are distant d1 from the center of the sphere, with one circle centered at longitude (Lam), the other at longitude −(Lam), and also that both circles are tangent to the meridian of longitude zero, then the planes of these circles intersect in a line lying in the plane y=0 and having in this plane the equation $$x\cos(th1)\cos(Lam) + z\sin(th1) = d1 \quad (13)$$

If the two circles in the upper ring are at latitude (th2) and distant d2 from the center of the sphere, with one circle centered at longitude 2(Lam), the other at −2(Lam), and also that both circles are tangent to the meridian of longitude zero, then the planes of these circles also intersect in a line lying in the plane y=0 and having in that plane the equation $$x\cos(th2)\cos(2(Lam)) + z\sin(th2) = d2 \quad (14)$$

The slope of line (13) is −cot (th1) cos (Lam).

The slope of line (14) is −cot (th2) cos (2(Lam)).

Since (th2) is greater than (th1), cot (th2) is less than cot (th1); also, since 2(Lam) is greater than (Lam), cos (2(Lam)) is less than cos (Lam). These relative magnitudes guarantee that line (13) and line (14) have different slopes therefore, since they lie in the same plane, they must intersect, and their point of intersection is common to the planes of all four circles.

The remaining case is that of neighboring rings of which the upper contains half as many circles as the lower, and also have the auxiliary circles, which define the filler quadragons. In this case any set of immediate neighbors consists of three circles, as in the first case, hence here also the extended planes of the circles meet in a point.

Having shown how the edges and vertices of the polyhydron are generated, it remains to determine the length of the edges. Assuming that on the edge whose length is to be determined, the point of contact with the sphere is located at angle (alf) relative to some reference position; and if the angular position of the nearest other contact point in a clockwise direction is (alf1), and the angular position of the nearest other contact point in a counterclockwise direction be (alf2); and with the definitions u1 = absolute value of (0.5(alf − alf1))

u2 = absolute value of (0.5(alf − alf2));

then if the radius of the circle on which the three contact points lie is r, the desired length of edge is $$r(\tan(u1)+\tan(u2)).$$

Given the design parameters of the polygonal faces as described above, the polyhedral structures of the present invention can be constructed in a number of ways that will be evident to the skilled artisan. The structures can be shaped from sheets of structural material such as wood, metal, stone, cement or plastic and joined with appropriate fastening means such as clips, brackets or adhesives. In the alternative, a framework can be first constructed that conforms to the intersections of the polygonal faces and then covered with an appropriate sheathing material such as wood, metal, plastic, glass, stucco, fabric and the like.

Polyhedrons prepared according to the present invention exhibit many advantages over previous dome structures. The polygons from which the present polyhedrons are prepared are more compatible with conventional rectangular building modules such as doors and windows than the triangular planes used in a geodesic dome as described in U.S. Pat. No. 2,682,235. In dome-shaped polyhedral structures, that is, spherical structures bisected substantially at their equator, the bases of polygons are perpendicular to the ground and parallel to opposite faces. Thus, it is convenient to join two or more domes together and the installation of doorways, arches and attachment to conventional rectilinear structures is facilitated.

When compared to domes using triangular faces for their principle units of construction, domes or polyhedrons of the present invention use fewer faces in their construction, thereby simplifying the assembly of the finished structure. In addition, the vertices of the present structures involve three-way or four-way joints as opposed to five or six-membered joints that result from domes having triangular faces.

The invention is further illustrated in the following examples, in which the dimensions of the polygonal faces of the polyhedra are determined using the formulas and estimating techniques described above.

EXAMPLE 1

A polyhedron was prepared having an equatorial ring of ten hexagons. A dome-shaped polyhedron was constructed with consecutive rings, from the equatorial ring to the polar cap, of ten more hexagons, five heptagons with five filler quadrigons, and a pentagonal polar cap. The radii of the inscribed circles of the various polygons were calculated for the equatorial ring, followed by successively more polar rings II, III, the polar cap, and the filler quadrigons. The ratios of the radii of the inscribed circles of these polygons to the radius of the sphere, taken as 1, are summarized in Table I.

TABLE I

| | Polygons in Ring | Inscribed circle radius/sphere radius |
|---|---|---|
| Equatorial ring (I) | (10) | 0.3090 |
| Ring II | (10) | 0.2704 |
| Ring III | (5) | 0.2974 |
| Polar caps | (1) | 0.2266 |
| Filler quadrigons | (5) | 0.1247 |

Using the radii so calculated, combined with the formulas and procedures discussed above, the angles were calculated at which each inscribed circle comes into contact with its neighbors, taking the 12 o'clock position as 0°. The results are summarized in Table II. Two sets of hexagons are found in ring II, which are identified as IIA and IIB, and which are mirror images of each other.

TABLE II

| Inscribed circles of polygons in ring | Pts. of contact of inscribed circles with neighbors |
|---|---|
| I | 29.18°, 90.0°, 150.82°, 209.18°, 270.0°, 330.82° |
| IIA | 16.70°, 81.04°, 146,14°, 213.86° 278.96°, 327.16° |
| IIB | 32.80°, 81.04°, 146.14°, 213.86°, 278.90°, 343.30° |
| III | 0.0°, 57.96°, 104.72°, 150.22°, 209.78°, 255.28°, 302.06° |
| Polar Cap | 0.0°, 72°, 144°, 216°, 288.° |
| Filler quadrigons | 45.9°, 135,86°, 224.14°, 314.1° |

It will be noted that the hexagonal polygons in II are mirror images of each other. Accordingly, differing contact angles are given for the left and right sides.

Using routine trigonometry as applied to the radii of the inscribed circles and the angles of contact, the lengths of the sides of the polygons in each ring are calculated.

A hemispherical dome was constructed with the above parameters to resemble an equatorially bisected polyhedron as illustrated in FIG. 1.

EXAMPLES 2–4

The general procedure of example 1 was repeated, using equatorial bands of 16, 20, and 24 hexagons in examples in 2, 3, and 4, respectively. Polyhedrons were generated for which the ring numbers and sizes and the ratio of polygon inscribed circles to the approximated spheres are summarized in Table IV.

TABLE IV

| Example | Ring | Polygons in Ring | Inscribed Circle Radius/Approximated Sphere Radius |
|---|---|---|---|
| 2 | I | 16 | 0.1951 |
| | II | 16 | 0.1846 |
| | III | 16 | 0.1579 |
| | IV | 8 | 0.2141 |
| | V | 4 | 0.1668 |
| | Polar caps | 1 | 0.0705 |
| 3 | I | 20 | 0.1564 |
| | II | 20 | 0.1509 |
| | III | 20 | 0.1361 |
| | IV | 20 | 0.1161 |
| | V | 10 | 0.1669 |
| | VI | 5 | 0.1561 |

TABLE IV-continued

| Example | Ring | Polygons in Ring | Inscribed Circle Radius/Approximated Sphere Radius |
|---|---|---|---|
| | Polar cap | 1 | 0.1118 |
| 4 | I | 24 | 0.1305 |
| | II | 24 | 0.1273 |
| | III | 24 | 0.1183 |
| | IV | 26 | 0.1054 |
| | V | 24 | 0.0909 |
| | VI | 12 | 0.1367 |
| | VII | 12 | 0.0907 |
| | VIII | 6 | 0.0929 |
| | Polar Caps | 1 | 0.0937 |

I claim:

1. A polyhedron that approximates a sphere, the sphere having an equator and two poles, the polyhedron having a plurality of polygonal faces, in which each vertex of the polyhedron is a junction of three or four polygonal edges, wherein each edge of each polygon is tangent to the approximated sphere at one point, each polygonal face being defined in a manner such that a circle can be inscribed therein that is tangent to each edge of the polygon at one point, wherein the polyhedron comprises two substantially parallel faces that are regular polygons said two parallel faces located at the poles to form polar caps and at least half of the remaining faces are selected from non-equilateral hexagons and pentagons, wherein the irregular polygonal faces are positioned in rings, including a first ring in a substantially equatorial position with respect to the approximated sphere and the centers of the inscribed circles of the polygons of more polar rings being at substantially the same latitude in each ring, and wherein successively more polar rings of polygons contain faces which are either equal in number or one-half the number of faces in the next most equatorial ring adjacent to each polar cap contains no more than one half the number of faces in the first ring.

2. A polyhedron of claim 1 wherein the equatorial ring consists of hexagonal faces equal in number to a power of two times an odd integer of from 1 to 9.

3. A polyhedron of claim 1 in which the polyhedron consists of polygonal faces having from 4 to 8 sides.

4. A polyhedron of claim 1 comprising an equatorial ring of at least 6 hexagons, each hexagon having two parallel sides, each of which sides are substantially perpendicular to the equatorial plane of an approximated sphere.

5. A polyhedron of claim 1 comprising an equatorial ring of at least 10 hexagons, each hexagon having two parallel sides, each of which sides are substantially perpendicular to the equatorial plane of an approximated sphere.

6. A polyhedron of claim 2 comprising an equatorial ring of at least 96 hexagons, each hexagon having two parallel sides, each of which sides are substantially perpendicular to the equatorial plane of an approximated sphere.

7. A polyhedron of claim 4 comprising 10 equatorial hexagons, and, in successive rings from the equator of the sphere to each pole, a ring of 10 hexagons, a ring alternating with five quadrigons and five heptagons, and an equilateral pentagonal polar cap.

8. A dome formed by a section of a polyhedron of claim 1.

* * * * *